United States Patent [19]

Massengale

[11] Patent Number: 4,704,810

[45] Date of Patent: Nov. 10, 1987

[54] BOWLING SHOE PROTECTOR

[76] Inventor: James Massengale, 5181 Nighthawk Dr., Cincinnati, Ohio 45247

[21] Appl. No.: 829,169

[22] Filed: Feb. 14, 1986

[51] Int. Cl.[4] ..... A43B 3/16; A43B 5/00

[52] U.S. Cl. ..... 36/130; 36/7.1 R

[58] Field of Search ..... 36/130, 7.1 R, 7.1 A, 36/7.2, 7.3, 7.4, 7.5, 98, 72 R, 71.5, 73, 95; 2/DIG. 6; 128/582

[56] References Cited

U.S. PATENT DOCUMENTS

| | | | |
|---|---|---|---|
| 1,104,357 | 7/1914 | Hassel | 36/7.1 R |
| 3,012,343 | 12/1961 | Dinkel | 36/130 |
| 3,099,884 | 8/1963 | Kixmiller et al. | 2/DIG. 6 |
| 3,399,470 | 9/1968 | Schofield | 36/7.1 R |
| 3,609,888 | 10/1971 | Rickman | 36/130 |
| 3,987,559 | 10/1976 | Roberts | 36/95 |
| 4,217,704 | 8/1980 | Whitaker | 36/7.1 R |
| 4,281,466 | 8/1981 | Malone | 36/130 |
| 4,301,604 | 11/1981 | Hamilton | 36/130 |
| 4,387,515 | 6/1983 | Baldwin | 36/130 |

FOREIGN PATENT DOCUMENTS

| | | | |
|---|---|---|---|
| 692113 | 8/1964 | Canada | 36/7.3 |

*Primary Examiner*—Louis K. Rimrodt

*Assistant Examiner*—Steven N. Meyers

[57] ABSTRACT

A bowling shoe protector includes a sole portion and an upper portion designed to fit snuggly about a conventional bowling shoe. The bowling shoe protector is made from a waterproof material such as rubber, vinyl or plastic. The surface of the inner sole of the bowling shoe protector includes a conditioning surface having an abrasive layer or lining. The abrasive layer or lining may be, for example, a component of a hook and loop type fastener, embedded abrasive material such as emery, plastic or wire, or a textured abrasive surface, or a steel wool-type material. The conditioning material on the inner surface of the sole of the bowling shoe protector conditions the exterior sole of a bowling shoe due to slippage which occurs between the inner surface of the bowling shoe protector and the exterior sole of an inserted bowling shoe. The slippage produces a reciprocating action which permits the conditioning surface to sand or abrade away any foreign matter, including droplets of water. The conditioning surface can also include a chemical absorbent which absorbs any moisture. The absorbent may be embedded within the conditioning surface, or it may be applied by spraying or sprinkling.

8 Claims, 6 Drawing Figures

BOWLING SHOE PROTECTOR

BACKGROUND OF THE INVENTION

1. Field of the Invention

The present invention relates to a bowling shoe protector in the form of a shoe or boot to be worn over bowling shoes to prevent the sole of the bowling shoe from becoming wet or being scratched. In particular, the present invention relates to a bowling shoe protector made from a resilient material whose inner sole or separate inner linear contains a mildly abrasive material to lightly condition the sole of a bowling shoe during use.

2. Prior Art

Foreign substances that cause the sole of the sliding shoe of a pair of bowling shoes to stick to the bowling lane have always been a threat to the bowler, and the most common cause of injury. When the bowling shoe sticks to the lane as the bowler delivers the ball, the sudden stopping of the forward motion trips the bowler and causes him or her to dangerously stumble or fall. Additionally, the tripping motion ruins the delivery resulting in missed pins and low scores. Foreign substances such as moisture are often nearly invisible in carpeted areas of a bowling alley. Therefore, the bowler is unaware that the shoe is impaired until it is too late.

To avoid this problem, the prior art has developed several different types of slippers to be worn by a bowler at all times when the bowler is away from the field of play. The following U.S. patents exemplify such bowling shoe protectors.

U.S. Pat. No. 4,281,466 to Malone discloses a bowling shoe protector having a flexible non-absorbent sole and an upper fabric body made of elastic or stretchable nylon, including a zipper running from the central toe area to the tongue area. This design permits the bowling shoe protector to be slightly expandable and slip over most all types of bowling shoes.

U.S. Pat. No. 4,301,604 to Hamilton discloses a bowling overshoe comprising a substantially oval or foot-shaped configuration made from latex rubber. Affixed to both the heel and toe end of the latex rubber sole is one-half of a velcro fastener (a hook and loop type fastener). In order to properly wear the bowling overshoe, the other half of the velcro fastener must be secured to the toe and heel portion of the bowling shoe itself. When it is desirable to wear the bowling overshoe, the bowling shoe is merely placed into the center of the substantially oval or foot-shaped sole and the half velcro fasteners attached to both the heel end and the toe of the overshoe are fastened to the corresponding half velcro fasteners on the bowling shoe.

U.S. Pat. No. 4,387,515 to Baldwin discloses a bowling shoe protector comprising a thin flexible sole having an enlarged foot-shaped configuration and a single support strap secured at the center of the sole. The strap includes the conventional velcro fastener to secure the bowling shoe protector onto the bottom of the bowling shoe. Additionally, the flexible sole can include two or more peripheral wall portions which project upwardly from the sole to prevent displacement of the bowling shoe past the peripheral edge of the bowling shoe protector.

U.S. Pat. No. 3,009,269 to Folk teaches a house boot having a flexible sole portion and an upright peripheral wall portion secured to the circumferential edge of the sole portion. The sole portion is designed to be slightly larger than one's shoe size so that one's shoe fits down within the upright peripheral edge of the house boot. The house boot also includes a centered strap which can be secured across one's shoe by means of a conventional buckle or velcro fastener.

U.S. Pat. No. 3,526,917 to Haywood, Jr. Discloses a foot floor scrubber comprising a half sole portion including a vertically extending toe covering portion and a heel strap. The half sole portion includes an abrasive material or pad securely fastened to the bottom of the half sole portion. The half sole portion, toe portion and heel portion are made of an elastic, flexible material such as latex or gum rubber. The foot floor scrubber is designed to be positioned over one's shoes so that the half sole is positioned beneath the ball's of one's feet, and the heel portion is stretched around and retained by the heel of one's shoe. In this position, the abrasive pad of the foot floor scrubber is now in contact with the floor. Marks on the floor can easily be removed by shuffling one's foot with the foot floor scrubber thereon, in a reciprocal manner.

One aspect of the present invention is to make a bowling shoe protector which completely covers all the surface area of the bowling shoe and is easy to slip on and slip off.

Another aim of the present invention is to provide a bowling shoe which is capable of lightly cleansing the sole of a bowling shoe thereby creating a clean dry surface every time the bowling shoe protector is worn by a bowler.

Another aim of the present invention is to provide the inside sole surface of a bowling shoe protector with a fine abrasive material, or an inner liner with fine abrasive material capable of lightly cleansing and buffing the sole of a bowling shoe, when the bowling shoe protector is properly worn.

Another aspect of the present invention is to provide a bowling shoe protector which creates a moisture free environment by removing or absorbing moisture in the sole of a bowling shoe to create a dry surface.

SUMMARY OF THE INVENTION

The above described aims and aspects of the present invention are achieved with the bowling shoe protector disclosed herein. The bowling shoe protector of the present invention comprises a shoe or a boot made from a flexible waterproof material such as neoprene rubber, latex rubber, gum rubber, vinyl, plastic, or the like. In order to allow the bowling shoe protector to be easily slipped on and slipped off, with either the low cut shoe version or the high top boot version, it is provided with a slit or a folded expanded area in the tongue area of a conventional shoe. The slit or expanded folded area is secured to an opposite portion by a velcro fastener, for example.

Either an inner liner or the inside surface of the sole portion of the bowling shoe protector is provided with a lightly abrasive material, such as one-half of a velcro fastener, impregnated fine emery, embedded wire or plastic, a molded, textured or corrugated abrasive surface, or laminated steel wool, to uniquely condition the outer sole of a bowling shoe. The means for conditioning the sole of the bowling shoe occurs due to the slippage between the flexible shell of the bowling shoe protector and the bowling shoe. This slippage occurs in a reciprocating manner and performs a sanding type movement by exerting downward pressure on the bottom of the bowling shoe, thereby cleaning and conditioning the shoe by substantially eliminating all moisture and foreign matter secured to the sole of the bowling shoe. This enables the bowler to cleanly slide during actual bowling as is desirable.

In the broadest sense, the present invention comprises a bowling shoe protector having a waterproof sole portion integrally formed with a continuous side wall portion having an opening therein; the sole includes an inside surface having a conditioning means affixed to said inside sole, said opening being sufficiently large to permit a bowling shoe to be inserted therein. The continuous side wall can either be the low cut version capable of covering just the bowling shoe, or the high top version capable of acting as a boot in addition to being a bowling shoe protector.

These and other features of the present invention will become apparent in view of the following description and the drawings.

BRIEF DESCRIPTION OF THE DRAWINGS

While the drawings of the invention aid in the understanding of the invention, the drawings are not meant to encompass all modification and variations of the present invention.

DESCRIPTION OF THE PREFERRED EMBODIMENTS

Figure 1:
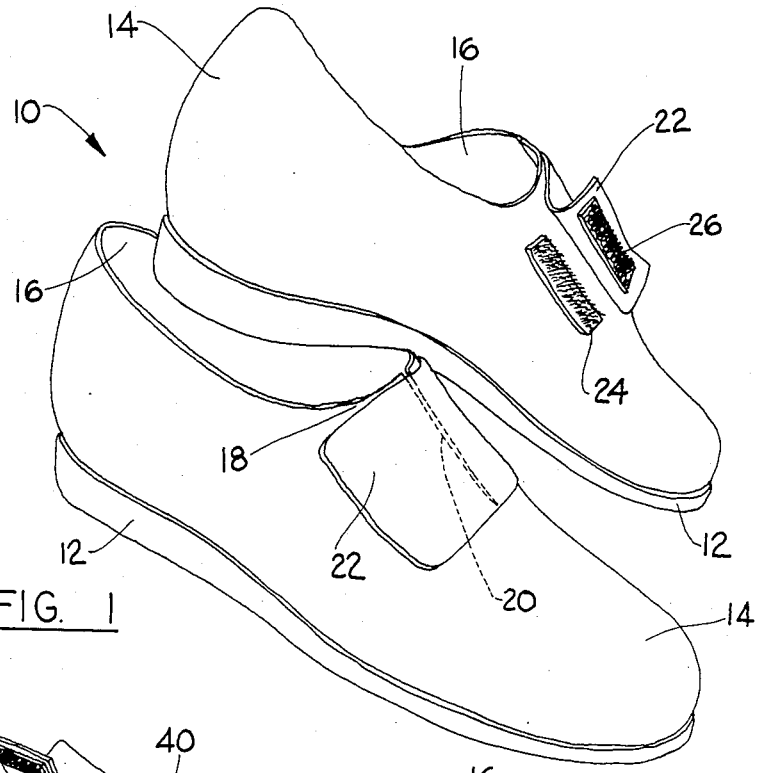
FIG. 1 is a perspective view of a pair of bowling shoe protectors of the present invention.

Turning to FIG. 1, there is shown a pair of bowling shoe protectors of the present invention, indicated generally by reference numeral 10. The bowling shoe protector can be made of a flexible, waterproof elastic material, such as neoprene, latex or gum rubber, vinyl, plastics or the like. The bowling shoe protector 10 includes a sole portion 12 on the bottom of the bowling shoe protector 10 and a continuous upper portion 14 integrally formed with the sole portion 12 by injection molding, by assembly, or the like. The upper portion 14 includes an opening 16 of a size to permit the insertion of a shoe, for example a bowling shoe, into the bowling shoe protector 10.

In the area of the tongue 18 of the bowling shoe protector, there is a slit 20 as illustrated in FIG. 1 in phantom. Slit 20 permits the opening 16 of the bowling shoe protector 10 to expand so that a bowler can easily insert the bowling shoe into the bowling shoe protector. The bowling shoe protector includes a fastening means having part of the fastening means on one side of slit 20 and the other part of the fastening means on the opposed side of slit 20 so that the fastening means can tightly secure the bowling shoe protector 10 about a bowling shoe. The fastening means can comprise any conventional fastening means such as a buckle or a pair of interlocking clasps, for example. Preferably, however, the fastening means includes a strap 22 fastened on one side of the slit 20 and a retainer 24 on the other side of the slit 20. The strap 22 includes on its free end one-half of a velcro fastener 26 secured beneath the free end. The retaining portion 24 comprises the complementary half of a velcro fastener so that mating the two halves 24 and 26 of the velcro fastener secure the strap 22 into position, closing slit 20 and securing the bowling shoe within the bowling shoe protector.

Figure 4:
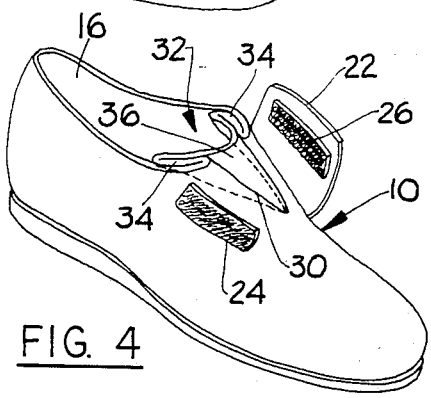
FIG. 4 is a fragmentary perspective view of a different modification of the tongue area of one of the bowling shoe protectors.

Instead of having a slit positioned in the tongue area of the bowling shoe protector, as illustrated in FIG. 1, the bowling shoe protector may have an expandable folded tongue 32, as illustrated in FIG. 4. The folded expandable tongue 32 includes a V-shaped opening 30, each edge of which is integrally connected to an overlapping tuck portion 34 extending from each side of the V-shaped opening 30. Secured to each end of the overlapping truck portions 34 is a centrally located, generally V-shaped section 36. In the closed position, each overlapping tuck portion 34 folds on top of the central section 36. In turn, the central section 36 lies upon the tongue area of the bowling shoe.

When it is desired to insert a bowling shoe into the bowling shoe protector 10, illustrated by FIG. 4, the user merely expands the central section 36, thus unfolding the overlapping tuck portions 34 and greatly increasing the size of opening 16 to permit easy access to the interior of the bowling shoe protector. This embodiment also prevents objectionable matter such as dirt, dust, water (rain) or snow from finding its way into the bowling shoe protector 10 between the bowling shoe and the bowling shoe protector.

Figure 3:
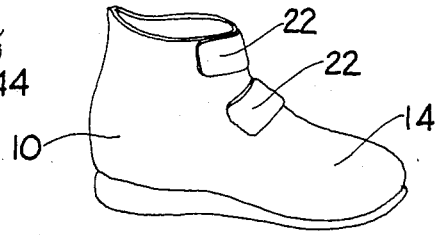
FIG. 3 is a perspective view of the high top embodiment of one bowling shoe protector in having a high cut.

While FIG. 1 illustrates the low cut version of the bowling shoe protector 10, FIG. 3 illustrates the high cut or boot-shaped version of the bowling shoe protector 10. In the high cut or boot version of the bowling shoe protector 10, it may be desirable to employ multiple straps 22 for securing the bowling shoe protector about the bowling shoe.

Figure 2:
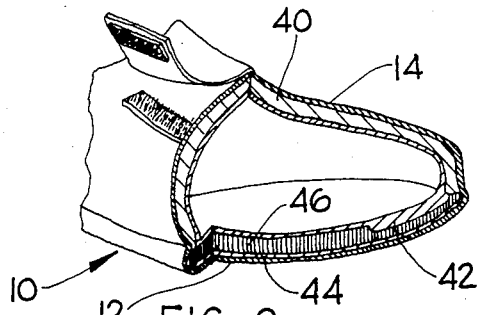
FIG. 2 is a fragmentary partial cut-away view of the bowling shoe protector of the present invention.
Figure 6:
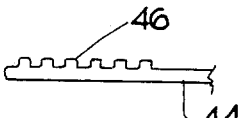
FIG. 6 is a cross-sectional plan view of the inside sole of a bowling shoe protector.
Figure 5:
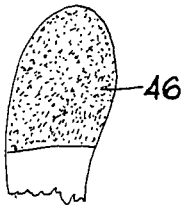
FIG. 5 is a top view of the inside sole showing the extent of the conditioning surface.

FIG. 2 illustrates a fragmentary cut-away view of the bowling shoe protector illustrated in FIG. 1 having a bowling shoe inserted therein. As previously stated, reference numeral 12 illustrates the sole of the bowling shoe protector 10, while reference numeral 14 is the upper portion of the bowling shoe protector. A bowling shoe 40 is positioned within the bowling shoe protector 10. The bowling shoe 40 has a typical leather sole 42. The inside surface of the bowling shoe protector 10 includes an inner sole or liner 44 having a conditioning surface 46 in contact with the sole 42 of the bowling shoe 40. The conditioning surface 46 can be any material capable of being slightly abrasive to the sole 42 of the bowling shoe 40 when the material is rubbed reciprocatingly across the sole of the bowling shoe. For example, the conditioning surface 46 can consist of one-half of a velcro fastener, such as the hook component, or an embedded material, such as fine emery, wire or plastic embedded into the surface of the inner sole of the bowling shoe protector, or a molded, textured or corrugated abrasive surface (as illustrated in FIG. 6), or a steel wool-like material. The conditioning surface 46, as illustrated in FIG. 5, is primarily beneath the toes and balls of one's feet, i.e., that portion of a bowler's foot which slides along the bowling lane during actual use. Generally, the conditioning surface 46 does not extend beneath the arch of one's foot.

Although the conditioning surface 46 cleans the soles of the bowling shoes, including the removal of moisture, it is preferable that surface 46 includes a chemical absorbent to aid in removing moisture. The chemical absorbent must be unable to harm leather, skin, or the material of the bowling shoe protector. The chemical absorbent can be impregnated within the inner liner 44 or the conditioning surface 46, or it can be sprayed or sprinkled on the inner sole or inner liner 44 or conditioning surface 46. Typically, chemical absorbents which meet the above limitations are: calcium sulfate, calcium chloride, magnesium sulfate, sodium sulfate, potassium carbonate or molecular sieve. Sodium sulfate is preferable because it is abundant, economical, and has a high capacity for moisture. Calcium sulfate is also advantageous because it changes color from blue to pink as it loses its ability to absorb moisture, thus visually indicating when it is spent as an absorbent. When the absorbent is spent, the inner sole or liner 44 can be replaced where it is separate from the bowling shoe protector, or more absorbent can be applied where the inner sole 44 is integrally formed with the bowling shoe protector.

In operation, the bowling shoe protector is loosened or opened in the conventional manner and a bowling shoe is positioned therein. When the bowling shoe protector is properly secured over the bowling shoe, the conditioning surface will reciprocally rub against the exterior sole of the bowling shoe by moving the bowling shoe back and forth with downward pressure or by walking or running. These actions cause slippage between the bowling shoe and the bowling shoe protector such that the exterior surface of the sole of the bowling shoe actually reciprocates with respect to the conditioning surface, thus creating a "sanding" motion whereby the conditioning surface lightly cleans the exterior sole of the bowling shoe. This cleaning removes not only moisture droplets, for example, but undesirable foreign particulate matter such as dirt and food particles, all of which may be found in a bowling alley away from the field of play.

Because the bowling shoe protectors are waterproof and because walking around with the bowling shoe protectors cleans the exterior sole of the bowling shoes, it is now possible to wear one's bowling shoes to the bowling alley without fear of rain or other foreign matter sticking to the sole of the bowling shoes.

While the invention was described in connection with the above preferred embodiments, it will be understood that it is not intended to limit the invention to these embodiments. On the contrary, it is intended to cover all alternatives, modifications and equivalents as may be included within the spirit and scope of the invention.

What is claimed is:

1. A bowling shoe protector comprising a flexible sole and a resilient upper portion, said sole and said upper portion capable of fitting snuggly around a bowling shoe, said sole being waterproof, said sole having a heel portion, an arch portion and a ball and toe portion, said ball and toe portions on said inner surface of said sole including a conditioning surface means for conditioning the exterior surface of a typical leather sole of a bowling shoe, said conditioning surface means comprising an abrasive surface, said surface being abrasive with respect to said exterior surface of the sole of said bowling shoe.

2. The bowling shoe protector of claim 1, wherein said conditioning surface means is a component of a velcro-type fastener.

3. The bowling shoe protector of claim 1, wherein said conditioning surface means comprises an abrasive substance embedded within the inner sole of said bowling shoe protector.

4. The bowling shoe protector of claim 3, wherein said abrasive substance is chosen from the class consisting of embedded fine emery, embedded wire and embedded plastic.

5. The bowling shoe protector of claim 1, wherein said conditioning surface means is a steel wool-type material.

6. The bowling shoe protector of claim 1, wherein said conditioning surface means is a textured surface.

7. The bowling shoe protector of claim 1, wherein said conditioning surface means includes a chemical absorbent to absorb moisture.

8. The bowling shoe protector of claim 7, wherein said chemical absorbent is chosen from the class consisting of calcium sulfate, calcium chloride, magnesium sulfate, sodium sulfate, potassium carbonate and molecular sieve.

* * * * *